US008815125B2

(12) United States Patent
Ogata

(10) Patent No.: US 8,815,125 B2
(45) Date of Patent: Aug. 26, 2014

(54) METHOD OF MANUFACTURING A RESISTOR PASTE

(75) Inventor: Yuko Ogata, Utsunomiya (JP)

(73) Assignee: E. I. du Pont de Nemours and Company, Wilmington, DE (US)

( * ) Notice: Subject to any disclaimer, the term of this patent is extended or adjusted under 35 U.S.C. 154(b) by 191 days.

(21) Appl. No.: 13/528,325

(22) Filed: Jun. 20, 2012

(65) Prior Publication Data

US 2013/0344342 A1 Dec. 26, 2013

(51) Int. Cl.
*H01B 1/02* (2006.01)

(52) U.S. Cl.
USPC ... 252/512; 252/506; 252/518.1; 252/519.13; 252/519.3; 136/236.1; 338/308; 428/209; 428/426; 501/16

(58) Field of Classification Search
USPC ..... 252/506, 512, 518.1, 519.13, 519.3; 338/308; 501/16; 136/236.1; 428/209, 428/426
See application file for complete search history.

(56) References Cited

U.S. PATENT DOCUMENTS

| | | | | |
|---|---|---|---|---|
| 4,110,124 | A * | 8/1978 | Robertson et al. | 136/236.1 |
| 4,720,418 | A * | 1/1988 | Kuo | 428/209 |
| 5,379,016 | A * | 1/1995 | Smith et al. | 338/308 |
| 5,491,118 | A | 2/1996 | Hormadaly | |
| 2006/0052229 | A1 * | 3/2006 | Tanaka et al. | 501/16 |

* cited by examiner

*Primary Examiner* — Khanh Tuan Nguyen

(57) ABSTRACT

A method of manufacturing a resistor paste comprising steps of: (a) preparing a basic resistor paste comprising, (i) a conductive powder, (ii) a first glass frit, and (iii) a first organic medium; and (b) preparing a glass paste as a TCR driver comprising, (iv) a second glass frit comprising manganese oxide, and (v) a second organic medium, (c) adding the glass paste to the basic resistor paste to obtain a resistor paste with a desired TCR.

9 Claims, 1 Drawing Sheet

METHOD OF MANUFACTURING A RESISTOR PASTE

FIELD OF THE INVENTION

The invention relates to a thick-film resistor, more specifically a method of manufacturing a resistor paste and a method of manufacturing a thick-film resistor.

TECHNICAL BACKGROUND OF THE INVENTION

Recently, a chip resistor has been getting down-sized. The temperature coefficient of resistance (TCR) increases as chip resistor is down-sized, while the TCR needs to be within a narrow spec, for example ±100 ppm/° C. Therefore, it is required to stock various types of chip resistor pastes containing a different amount of a TCR driver so that a chip resistor paste with an appropriate TCR can be selected depending on the size of a chip resistor.

U.S. Pat. No. 5,491,118 discloses a resistor paste that comprises, by weight %, (a) 5-65 wt % of ruthenium-based conductive materials; (b) 35-95 wt % of glass composition consisting essentially of by mole % 5-70% $Bi_2O_3$, 18-35% $SiO_2$, 0.1-40% CuO, 5-25% ZnO, 0.5-40% CoO, 0.5-40% $Fe_2O_3$, and 0.5-40% MnO, wherein the glass composition is free of lead and cadmium; and, all of (a) and (b) dispersed in an organic medium.

SUMMARY OF THE INVENTION

An objective of the invention is to provide a method of manufacturing a chip resistor paste, by which the TCR of chip resistors can be easily lowered.

One aspect relates to a method of manufacturing a resistor paste comprising steps of: (a) preparing a basic resistor paste comprising, (i) a conductive powder, (ii) a first glass frit, and (iii) a first organic medium; and (b) preparing a glass paste as a TCR driver comprising, (iv) a second glass frit comprising manganese oxide, and (v) a second organic medium, (c) adding the glass paste to the basic resistor paste to obtain a resistor paste with a desired TCR.

Another aspect relates to a method of manufacturing a thick-film chip resistor, comprising the steps of applying on a substrate a resistor paste prepared according to the above method; and firing the resistor paste to obtain a thick-film chip resistor.

Another aspect relates to a thick-film chip resistor made by the method above.

The thick-film resistor having the desired TCR can be easily obtained by the present invention.

DETAILED DESCRIPTION OF THE INVENTION

Figure 1:
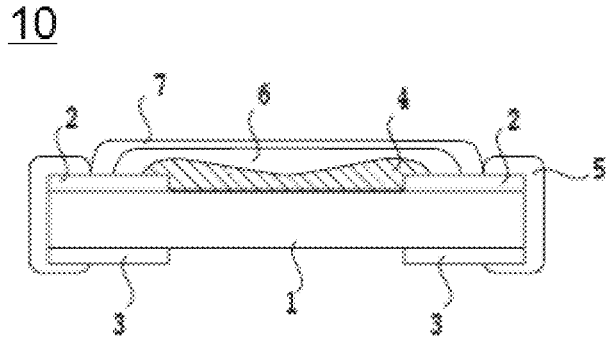
FIG. 1 is a schematic cross-sectional diagram of a chip resistor which uses an electrode according to the present invention.

The method of manufacturing a resistor paste uses a basic resistor paste and a glass paste as a TCR driver for the basic resistor paste. The glass paste is added to the basic resistor paste to reduce the TCR of the basic resistor paste down to a desired value. The TCR of a chip resistor varies depending on conditions, for example resistor size, or type of terminal electrode.

Resistor Paste Manufacturing

The basic resistor paste and the glass paste are separately prepared.

The basic resistor paste comprises at least (i) a conductive powder, (ii) a first glass frit, and (iii) a first organic medium. The conductive powder and the first glass frit are dispersed into the first organic medium, for example by using a mixer to form a viscous composition called "paste," having suitable consistency and rheology for an applying method to a substrate, for example screen printing.

Final mixing and dispersion of powder particles is accomplished by the use of a three-roll mill in an embodiment.

A final paste viscosity between 70 and 300 Pa-sec is suitable for applying, especially between 100 and 300 Pa-sec for screen printing, as measured at 10 rpm and 25° C. with a Brookfield HBF viscometer (Middleboro, Mass.) with #14 spindle and 6R cup. The degree of dispersion as measured by fineness of grind can be 10 μm or less at $4^{th}$ scratch.

The basic resistor paste can be manufactured by the method above or the basic resistor paste can be purchased from the market.

Next, apart from the basic resistor paste, the glass paste is made. The glass paste works as a TCR driver for the basic resistor paste.

The glass paste comprises at least (iv) a second glass frit and (v) a second organic medium. The second glass frit is dispersed into the second organic medium as well as the basic resistor paste. A final paste viscosity of the glass paste can be in the range of 70 and 300 Pa-sec. The degree of dispersion as measured by fineness of grind can be 10 μm or less at $4^{th}$ scratch.

Finally, the basic resistor paste and the glass paste are mixed to form the resistor paste.

The glass paste is added to the basic resistor paste to lower the TCR down to a desired value. The amount of the glass paste to add can be determined according to the following method, in an embodiment.

A declining trend line can be created by measuring at least two points of the hot temperature coefficient of resistance (HTCR). The declining trend line in a chart with X axis of amount of the glass paste to be added and Y axis of the HTCR could indicate the amount of the glass paste to be added to the basic resistor paste to obtain a desired TCR.

The HTCR of the chip resistor can be measured by the following method in an embodiment.

Resistances are measured at 25° C. and 125° C. using a two-point probe method. A multimeter and a current source are used to carry out the measurements. A thermal test chamber can be used to achieve the measurement temperatures of 25° C. and 125° C. Sheet resistance data is reported as ohms/square at 25° C. The hot temperature coefficient of resistance (HTCR) is defined as $[(R_{125°\,C.}-R_{25°\,C.})/(R_{25°\,C.}\times\Delta T)]\times 1{,}000{,}000$, where $R_{125°\,C.}$ is the resistivity (ohm) at 125° C., and $R_{25°\,C.}$ is the resistivity (ohm) at 25° C.

Alternatively, the cold temperature coefficient of resistance ("CTCR") defined as $[(R_{-55°\,C.}-R_{25°\,C.})/(R_{25°\,C.}\times\Delta T)]\times 1{,}000{,}000$, where $R_{-55°\,C.}$ is the resistivity (ohm) at −55° C., and $R_{25°\,C.}$ is the resistivity (ohm) at 25° C., can be available instead of the HTCR because the CTCR has a similar trend to the HTCR.

The unit of the HTCR and the CTCR is ppm/° C. in an embodiment.

Once the declining trend line of the HTCR is created, the amount of the glass paste to be added to the basic resistor paste in order to reduce the TCR of the basic resistor paste down to the desired TCR can be easily determined.

The declining trend line can be drawn by "Delta HTCR" instead of the HTCR. The Delta HTCR is defined as the difference between a HTCR value of a pure basic resistor paste without a glass paste and a HTCR value of the basic resistor paste to which the glass paste is added as shown in Example below. The Delta HTCR could indicate how much of the glass paste can be added to the basic resistor paste according to how much of the HTCR needs to be lowered.

It is easy to decrease the TCR by using the present invention where the glass paste as the TCR driver is adequately added to the basic resistor. The process of mixing pastes is easy while adding a powder as a TCR driver such as a metal oxide powder or a glass frit needs specialized skills. Especially a small amount of the powdery TCR driver hardly disperses into a paste evenly.

Moreover, the present invention can make is unnecessary to stock various types of chip resistor pastes containing different amount of TCR drivers so that a chip resistor paste with an appropriate TCR can be selected depending on the size of a chip resistor. A chip resistor with a desirable TCR can be manufactured by just mixing the basic resistor and the adequate amount of the glass paste as the TCR driver.

Materials

Materials of the basic resistor paste and the glass paste are explained respectively below.

Basic Resistor Paste

The basic resistor paste can be manufactured by known method. If available, the basic resistor paste can be obtained in the market. The basic resistor paste comprises at least (i) a conductive powder, (i) a first glass frit, and (iii) an organic vehicle.

(i) Conductive Powder,

The conductive powder is any powder that enables to transport electrical current. There is no restriction on the conductive powder. The resistor paste can comprise a ruthenium pyrochlore oxide, a ruthenium oxide, silver, palladium, copper, carbon, or a mixture thereof in an embodiment.

The ruthenium pyrochlore oxide cab be a multi-component compound of $Ru^{4+}$, $Ir^{4+}$ or a mixture of these expressed by the following formula:

$$(M_xBi_{2-x})(M'_yM''_{2-y})O_{7-z}$$

wherein, M is selected from the group consisting of yttrium, thallium, indium, cadmium, lead, copper and rare earth metals, M' is selected from the group consisting of platinum, titanium, chromium, rhodium and antimony, M" is ruthenium, x denotes 0 to 2 with the proviso that x is less than or equal to 1 for monovalent copper, y denotes 0 to 0.5 with the proviso that when M' is rhodium or two or more of platinum, titanium, chromium, rhodium and antimony, y stands for 0 to 1, and z denotes 0 to 1 with the proviso that when M is divalent lead or cadmium, z is at least equal to x/2.

The ruthenium pyrochlore oxide can be bismuth ruthenate ($Bi_2Ru_2O_7$), lead bismuth ruthenate ($Pb_{1.5}Bi_{0.5}Ru_2O_{6.2}$), cadmium bismuth ruthenate ($CdBiRu_2O_{6.5}$), lead ruthenate ($Pb_2Ru_2O_6$) or a mixture thereof in an embodiment. These compounds are stable even when heated to at 1000° C. in air.

For the ruthenium pyrochlore oxide, U.S. Pat. No. 3,583,931 can be herein incorporated by reference.

The conductive powder such as the ruthenium oxide powder, silver, palladium, copper, carbon, other than the pyrochlore oxides can be available as well.

The amount of the conductive powder can be decided according to the desired resistivity. The conductive powder can be 1 to 30 wt % in an embodiment.

(ii) First Glass Frit

The first glass frit is used as an inorganic binder to melt and bind the conductive powder during firing.

There is no restriction on the first glass frit. Any type of glass frit can be used as the first glass frit. The followings are examples. Silicon-aluminum-boron (Si—Al—B) base glass frit containing 70 wt % of $SiO_2$, $Al_2O_3$ and $B_2O_3$ in total, based on the total amount of the first glass frit, Silicon-aluminum-calcium (Si—Al—Ca) base glass frit containing 70 wt % of $SiO_2$, $Al_2O_3$ and CaO in total, based on the total amount of the first glass frit. Lead-silicon (Pb—Si) base glass frit containing 70 wt % of PbO and $SiO_2$ in total, based on the total amount of the first glass frit. Bismuth-aluminum-boron (Bi—Al—B) base glass frit containing 70 wt % of $Bi_2O_3$, $Al_2O_3$ and $B_2O_3$ in total, based on the total amount of the first glass frit.

Softening point of the first glass frit can be 480 to 700° C. in an embodiment, 450 to 680° C. in another embodiment, 450 to 650° C. in another embodiment. When the softening point is in the ranges, glass frit can melt properly to bind the conductive powder. In this specification, "softening point" is determined by the fiber elongation method of ASTM C338-57.

The amount of the first glass frit can be decided according to the desired resistivity. The first glass frit can be 20 to 60 wt % in an embodiment.

(iii) First Organic Medium

The first organic medium is used as an organic binder. The first organic medium in which the inorganic components such as conductive powder and the first glass frit disperse is called "paste", having suitable viscosity for applying on a substrate.

The first organic medium can be made of any of various organic mediums to contain an organic polymer and optionally a solvent.

The most frequently used polymer for this purpose is ethyl cellulose. Other examples of polymers include ethyl hydroxyethyl cellulose, wood rosin, mixtures of ethyl cellulose and phenolic resins, polymethacrylates of lower alcohols and monobutyl ether of ethylene glycol monoacetate.

The solvent can comprise ester alcohols or terpineol, kerosene, dibutylphthalate, butyl carbitol, butyl carbitol acetate, hexylene glycol, alcohol esters or a mixture thereof.

In an embodiment, the first organic medium can be a mixture of ethyl cellulose and terpineol.

The first organic medium can be 30 to 50 wt % in an embodiment, 35 to 45 wt % in another embodiment, 37 to 42 wt % in another embodiment, based on the weight of the basic resistor paste.

Examples of the basic resistor paste which are commercially available can be 0010 A for 1 ohm, 0020 A (2 ohm), 0030 A (3 ohm), 0040 A (4 ohm), 0050 A (5 ohm), 0060 A (6 ohm), 0070 A for 7 ohm (E.I. du Pont de Nemours and Company).

For the basic resistor paste, U.S. Pat. No. 4,707,346, US20090261307, and US20110227003 can be herein incorporated by reference.

Glass Paste as a TCR Driver

The glass paste as a TCR driver comprises (iv) a second glass frit comprising manganese oxide, and (v) an organic medium.

(iv) Second Glass Frit

The second glass frit takes an important role to lower the TCR of the resistor. The second glass frit comprises manganese oxide (MnO). MnO can contribute to decreasing the TCR. The amount of MnO can be adjusted according to the TCR performance. The TCR decrease sharply when the second glass frit contains relatively high amount of MnO. The TCR decrease slowly when the second glass frit contains relatively small amount of MnO.

MnO can be at least 3 wt % in an embodiment, at least 5 wt % in another embodiment, at least 13 wt % in another embodiment, at least 26 wt % in an embodiment, at least 32 wt % in another embodiment, and at least 45 wt % in still another embodiment, based on the weight of the second glass frit.

MnO can be 69 wt % or less in an embodiment, 66 wt % or less in another embodiment, 62 wt % or less in another embodiment, 59 wt % or less in another embodiment, based on the weight of the second glass frit.

Such amount of MnO can enable the glass paste to properly lower TCR.

The second glass frit can further comprise an oxide selected from the group consisting of silicon oxide ($SiO_2$), boron oxide ($B_2O_3$), aluminum oxide ($Al_2O_3$), lead oxide (PbO) and a mixture thereof. $SiO_2$, $B_2O_3$ and PbO can function as glass formers. $Al_2O_3$ can function as an intermediate among the glass former.

$SiO_2$ can be 5 to 30 wt % in an embodiment, 10 to 27 wt % in another embodiment, 14 to 25 wt % in another embodiment, 16 to 23 wt % in another embodiment, based on the weight of the second glass frit.

$B_2O_3$ can be 10 to 42 wt % in an embodiment, 13 to 39 wt % in another embodiment, 15 to 35 wt % in another embodiment, 16 to 30 wt % in another embodiment, based on the weight of the second glass frit.

$Al_2O_3$ can be 0.01 to 10 wt % in an embodiment, 0.1 to 8 wt % in another embodiment, 1 to 8 wt % in another embodiment, 2 to 7 wt % in another embodiment, based on the weight of the second glass frit.

PbO can be 25 to 65 wt % in an embodiment, 30 to 60 wt % in another embodiment, and 40 to 55 wt % in still another embodiment, based on the weight of the second glass frit.

In an embodiment, the second glass frit can be lead-free glass.

Examples of the second glass frit composition are listed in Table 1. The second glass frit containing relatively high amount of MnO such as Glass A can be available when desiring to sharply decrease the TCR. The second glass fit containing relatively low amount of MnO such as Glass B can be useful when desiring to slowly decrease the TCR.

TABLE 1

| Composition | Glass frit A | Glass frit B | Glass frit C |
|---|---|---|---|
| MnO | 51.7 | 6.5 | 12.6 |
| $SiO_2$ | 19.5 | 25.2 | 23.7 |
| $B_2O_3$ | 23.3 | 14.1 | 13.2 |
| $Al_2O_3$ | 5.5 | 4.1 | 3.8 |
| PbO | — | 50.1 | 46.7 |
| Ts | 580° C. | 600° C. | 595° C. |

The glass frit composition is described herein as starting materials with certain amount in weight percentage (wt %). Such nomenclature is conventional to one of skill in the art. In other words, the glass frit composition contains certain components, and the weight percentages of these components are expressed as a percentage of the corresponding oxide form. As recognized by one skilled in the art in glass chemistry, a certain portion of volatile species can be released during the process of making the glass. An example of a volatile species is oxygen.

If starting with a fired glass, one skilled in the art can calculate the percentages of starting components described herein elemental constituency by, but not limited to, Inductively Coupled Plasma-Emission Spectroscopy (ICP-ES).

In regard to content, the second glass frit can be at least 10 wt % in an embodiment, at least 14 wt % in another embodiment, and 18 wt % in still another embodiment, based on the total weight of the glass paste. The second glass frit can be 60 wt % or less in an embodiment, 55 wt % or less in another embodiment, and 50 wt % or less in another embodiment, based on the total weight of the glass paste.

The content of the second glass frit can be same or similar to the content of the inorganic materials in the basic resistor paste. When the amounts of the inorganic materials are same or similar, the glass paste can be smoothly mixed with the basic resistor paste.

Softening point of the second glass frit can be 350 to 680° C. in an embodiment, 400 to 650° C. in another embodiment, 420 to 610° C. in another embodiment. When the softening point is in the ranges, glass frit can melt properly to bind the conductive powder. In this specification, "softening point" is determined by the fiber elongation method of ASTM C338-57.

The glass frit described herein can be manufactured by conventional glass making techniques. The following procedure is one example. The metal oxides as ingredients are weighed then mixed in the desired proportions and heated in a furnace to form a melt in platinum alloy crucibles. As well known in the art, heating is conducted to a peak temperature of 800 to 1400° C. and for a time such that the melt becomes entirely liquid and homogeneous.

The molten glass is then quenched between counter rotating stainless steel rollers to form a 10-15 mil thick platelet of glass. The resulting glass platelet is then milled to form a powder with its 50% volume distribution set to a desired target, for example from 0.5 to 3.0 μm.

One skilled in the art of producing glass frit may employ alternative synthesis techniques such as but not limited to water quenching, sol-gel, spray pyrolysis, and others appropriate for making powder forms of glass. US patent application numbers US 2006231803 and US 2006231800, which disclose a method of manufacturing a glass useful in the manufacture of the glass frits described herein, are hereby incorporated by reference herein.

One skilled in the art would recognize that the choice of starting materials could unintentionally include an impurity that can be incorporated into the glass during processing. For example, the impurity can be present in the range of hundreds to thousands ppm. A resistor can have the effect of the present invention described herein, even if the second glass frit includes the impurity.

(v) Second Organic Medium

The second organic medium is used as an organic binder. The second organic medium in which the second glass frit disperses is called "paste", having suitable viscosity for applying on a substrate.

Any types of organic medium can be used for the second organic medium as well as the first organic medium. The second organic medium can be the same as the first organic medium, or can be different from the first organic medium.

In an embodiment, the second organic medium can be a mixture of terpineol and ethyl cellulose.

The second organic medium can be 40 to 90 wt % in an embodiment, 45 to 86 wt % in another embodiment, and 50 to 82 wt % in another embodiment, based on the total weight of the glass paste.

In an embodiment, the glass paste can consist of the second glass frit and the organic medium.

(vi) Third Glass Frit

The glass paste can further comprise a third glass frit. The third glass frit that possesses a specific property can be used in combination with the second glass frit to achieve a good balance of properties, such as TCR adjustment, adhesion, and firing property.

The third glass frit can comprise alkali-silicate glass frit, alkali earth-silicate glass frit, alkali-borate glass frit, alkali earth-borate glass frit or a mixture thereof, in an embodiment.

In another embodiment, the third glass frit can be alkali earth-silicate glass frit comprising a metal oxide selected from the group consisting of silicon oxide ($SiO_2$), calcium oxide (CaO), boron oxide ($B_2O_3$), barium oxide (BaO) and a mixture thereof. The alkali earth-silicate glass frit can improve firing property of conductive powder.

$SiO_2$ can be 20 to 70 wt % in an embodiment, 26 to 66 wt % in another embodiment, 32 to 62 wt % in another embodiment, 40 to 58 wt % in another embodiment, based on the weight of the third glass frit.

CaO can be 10 to 35 wt % in an embodiment, 14 to 32 wt % in another embodiment, 18 to 30 wt % in another embodiment, based on the weight of the third glass frit.

$B_2O_3$ can be 2 to 25 wt % in an embodiment, 3 to 22 wt % in another embodiment, 6 to 20 wt % in another embodiment, 5 to 10 wt % in another embodiment, based on the weight of the third glass frit.

BaO can be 3 to 20 wt % in an embodiment, 5 to 18 wt % in another embodiment, 8 to 16 wt % in another embodiment, based on the weight of the third glass frit.

In another embodiment, the third glass frit can further comprise one or more of metal oxide selected from the group consisting of magnesium oxide (MgO), aluminum oxide ($Al_2O_3$), zinc oxide (ZnO), potassium oxide ($K_2O$), sodium oxide ($Na_2O$) and a mixture thereof.

MgO can be 0.01 to 5 wt % in an embodiment, 0.05 to 5 wt % in another embodiment, 0.1 to 4.6 wt % in another embodiment, 0.15 to 3.2 wt % in another embodiment, based on the weight of the third glass frit.

$Al_2O_3$ can be 1 to 20 wt % in an embodiment, 1.5 to 18 wt % in another embodiment, 2.1 to 17 wt % in another embodiment, based on the weight of the third glass frit.

$Na_2O$ can be 0.01 to 5 wt % in an embodiment, 0.05 to 4.3 wt % in another embodiment, 0.12 to 4 wt % in another embodiment, based on the weight of the third glass frit.

$K_2O$ can be 0.01 to 1 wt % in an embodiment, 0.05 to 0.9 wt % in another embodiment, 0.08 to 0.5 wt % in another embodiment, based on the weight of the third glass frit.

In another embodiment, the third glass frit can further comprise one or more of metal oxide selected from the group consisting of zinc oxide (ZnO), potassium oxide ($K_2O$), sodium oxide ($Na_2O$), strontium oxide (SrO), tian oxide ($TiO_2$), tin oxide ($SnO_2$), copper oxide (CuO) and a mixture thereof.

ZnO can be 1 to 16 wt % in an embodiment, 2.1 to 15 wt % in another embodiment, 3.6 to 12 wt % in another embodiment, based on the weight of the third glass frit.

$K_2O$ can be 0.01 to 3 wt % in an embodiment, 0.05 to 2.1 wt % in another embodiment, 0.07 to 1.6 wt % in another embodiment, based on the weight of the third glass frit.

$Na_2O$ can be 0.01 to 9 wt % in an embodiment, 0.1 to 7.5 wt % in another embodiment, 0.15 to 5 wt % in another embodiment, based on the weight of the third glass frit.

SrO can be 1 to 16 wt % in an embodiment, 2.1 to 15 wt % in another embodiment, 3.6 to 12 wt % in another embodiment, based on the weight of the third glass frit.

$TiO_2$ can be 1 to 12 wt % in an embodiment, 2 to 10 wt % in another embodiment, 3 to 8 wt % in another embodiment, based on the weight of the third glass frit.

$SnO_2$ can be 1 to 8 wt % in an embodiment, 2 to 5 wt % in another embodiment, 3 to 4.5% in another embodiment, based on the weight of the third glass frit.

CuO can be 0.01 to 3 wt % in an embodiment, 0.06 to 2.5 wt % in another embodiment, 0.1 to 2.1 wt % in another embodiment, based on the weight of the third glass frit.

Examples of the third glass frit are shown in Table 2. Unless stated otherwise, as used herein, weight percent of the compositions is based on the weight of the third glass frit.

TABLE 2

| Composition | Glass I | Glass II | Glass III |
|---|---|---|---|
| $SiO_2$ | 50.2 | 46.2 | 24.9 |
| CaO | 29.0 | 22.0 | — |
| $B_2O_3$ | 7.0 | 10.2 | 19.6 |
| BaO | — | — | 17.3 |
| MgO | 0.2 | 2.3 | 3.0 |
| $Al_2O_3$ | 12.8 | 9.8 | 3.8 |
| FeO | 0.1 | — | — |
| $Na_2O$ | 0.3 | — | 3.6 |
| $K_2O$ | 0.1 | — | — |
| ZnO | — | 8.0 | 9.2 |
| SrO | — | — | 11.3 |
| $TiO_2$ | — | — | 5.3 |
| $SnO_2$ | — | — | 2.0 |
| CuO | — | 1.5 | — |
| Ts (° C.) | 918 | 850 | 750 |

Softening point of the third glass fit can be 700 to 950° C. in an embodiment, 720 to 940° C. in another embodiment, 740 to 930° C. in another embodiment. The third glass frit having such relatively high softening point can be effective on improving sintering performance of the resistor paste.

(vii) Inorganic Additive

The glass paste can further comprise an inorganic additive to improve properties such as adhesion, sintering performance, even the TCR of the chip resistor.

In an embodiment, the inorganic additive can be selected from the group consisting of silver oxide, zirconium silicate, and niobium oxide, silicon oxide, zirconium oxide, aluminum oxide, titanium oxide, cobalt oxide, manganese oxide, bismuth oxide, tin oxide and a mixture thereof. When adding MnO powder to the glass paste, the glass paste can be more effective on decreasing the TCR.

In an embodiment, the inorganic additive can be 0.1 to 8 wt %, 1 to 5 wt % in another embodiment, 1.5 to 3 wt % in another embodiment, based of the weight of the glass paste.

Chip Resistor Manufacturing

A chip resistor can be manufactured by using the resistor paste described above. A chip resistor is a square shape in an embodiment, for example, 0402 (0.4 mm×0.2 mm), 1608 (16 mm×0.8 mm), 3216 (32 mm×16 mm), 5025 (50 mm×25 mm). An example of manufacturing a chip resistor using the resistor paste is explained by referring to FIG. 1.

An Ag paste is applied on a substrate to form thick film Ag electrode 2, 3 on both of the front side and the back side of the substrate 1. The substrate 1 can be 1 to 5 squares and 0.5 to 1 mm in thickness of substrates made of alumina, aluminum nitride or glass. To apply the Ag paste, screen-print can be available. The screen printing is accomplished using an automatic screen printer such as those from Engineering Technical Products, Sommerville, N.J. The Ag paste on the substrate can be fired at 600 to 900° C. for 5 to 15 minutes. DuPont 5421E terminations are recommended as the Ag paste. The firing condition for the recommended can be 30 minute firing profile with 10 minutes at the peak firing temperature of 850° C. The thickness of the front side Ag electrodes 2 and the back side Ag electrodes 3 can be 5 to 20 μm.

The resistor paste is applied on the substrate 1 and the Ag electrode 2 on the front side. Screen-print can be available to apply the resistor paste.

The thick film resistor 4 can be obtained by firing the applied resistor paste. Drying step can be carried out before firing step, although it is not essential. The drying condition can be 100 to 200° C. for 5 to 20 minutes.

Firing can be carried out in a furnace. The firing condition can be with the peak temperature at 600 to 900° C. for 5 to 15 minutes. The firing total time can be 15 to 45 minutes, for example from an entrance to an exit of the furnace. The organic medium in the pastes is burned off during the firing. The thickness of the thick film resistor 4 can be 5 to 20 μm.

Terminal electrodes 5 for electrically connecting the front side Ag electrodes 2 and the back side Ag electrodes 3 are formed on sidewalls of the substrate 1 to cover portions of the Ag electrodes 2, 3. The terminal electrodes 5 can be formed by screen-printing an Ag paste onto the sidewalls of the substrate 1 or by dipping the sidewalls of the substrate into an Ag paste.

A glass coat 6 and a resin coat 7 are deposited on the surface of the thick film resistor 4.

For manufacturing chip resistors, WO2009129468 WO2009129378 US20090261307 can be can be herein incorporated by reference.

EXAMPLES

The present invention is illustrated by, but is not limited to, the following examples.

Example 1

Preparing a Resistor Paste

A basic resistor paste was 0020A produced by E. I. du Pont de Nemours and Company.

To make a glass paste as a TCR driver, the second glass frit and organic medium below were mixed and kneaded by a roll mill.

Second glass frit: 60 wt % of Glass A in Table 1.

Organic medium: 40 wt % of a mixture of terpineol and ethyl cellulose.

Different amount of the glass paste, 0, 2, 4 parts by weight respectively, was added to 100 parts by weight of the basic resistor paste, and kneaded by a roll mill to make a resistor paste. The resistor paste viscosity was 150 Pa·s. The degree of dispersion as measured by fineness of grind was 10/4 or less.

Manufacturing a Thick-Films Resistor

The resulting resistor paste was screen printed on a 25 mm long×25 mm wide×0.6 mm thick of 96% alumina substrate through a 325 mesh stainless steel screen mask. The printed pattern was 0.5 mm×0.5 mm. A thick film resistor can be obtained by screen-printing the resistor paste on the substrate and on front electrodes that was previously formed with an Ag paste onto the substrate.

The substrate with the printed resistor paste was then dried at 150° C. for 10 minutes in an oven. The resistor paste thickness after drying was 15 μm in average.

The thick film resistor was obtained by firing the dried resistor paste in a muffle furnace (Model 809, Koyo Lindberg Co., Ltd) at peak temperature setting with 850° C. for 10 minutes. Firing time from furnace entrance to exit was 30 minutes.

Measurement of the HTCR

The resistance of the thick-film resistor was measured with a terminal-patterned probe using an auto-range auto-balance digital ohmmeter (4220, S&A Inc.) with a precision current source (6220, KEITHLEY) and a digital multi-meter (34410A, Agilent Technologies, Inc.) with a precision of 0.01%. Specifically, samples were laid on the terminal post in the chamber, and electrically connected with the digital ohmmeter. The temperature in the chamber was adjusted to 25° C. and 125° C., respectively to record resistance at the each temperature.

The HTCR was calculated from the following equation wherein R stands for resistance at each temperature:

$$\text{HTCR(ppm/° C.)}=((R_{125°\,C.}-R_{25°\,C.})/R_{25°\,C.})\times 10000).$$

The Delta HTCR was difference calculated from the following equation.

Delta HTCR(ppm/° C.)=−(HTCR by the basic resistor paste−HTCR by the resistor paste containing 100 parts by weight of the basic resistor paste and the certain amount of the glass paste as the TCR driver)

Result

Figure 2:
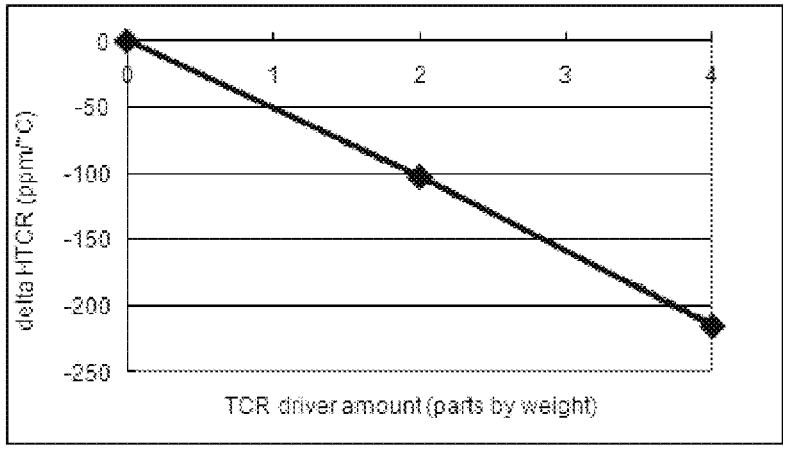
FIG. 2 is a graph explaining a correlation between the amount of the glass paste and HTCR in Example 1.

The HTCR was lowered in proportion by adding the glass paste as illustrated in FIG. 2. When the glass paste to be added was 2 or 4 parts by weight, the HTCR was decreased −103 ppm/° C. and −215 ppm/° C. respectively from the HTCR by the basic resistor paste. From the FIG. 2, it can be visually presumable that the glass paste amount to be added would be 1 part by weight when the HTCR of the basic resistor paste needs to be lowered by 50 ppm/° C.

Example 2

A thick film resistor was obtained and the delta HTCR was measured in the same manner of Example 1 except that the glass paste further comprised 33 wt % of a third glass frit based on the total weight of the glass paste. The third glass frit was glass I listed in Table 2 above. The glass paste with amount of 0, 0.74, 1.00, 1.26, and 2.00 parts by weight, respectively was added to 100 parts by weight of the basic resistor paste, and the mixture was kneaded by a roll mill to make a resistor paste.

Figure 3:
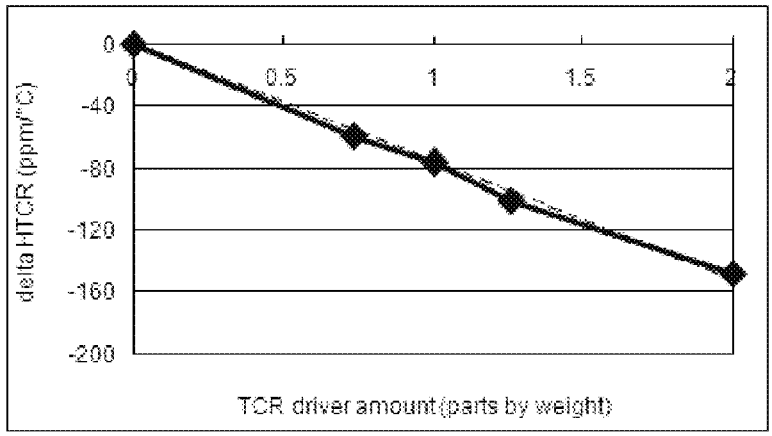
FIG. 3 is a graph explaining a correlation between the amount of the glass paste and HTCR in Example 2.

As a result, delta TCR also lowered in proportion by adding the glass paste containing the third glass frit as shown in FIG. 3 where it can be visually presumable that the glass paste to be added would be 0.5 parts by weight when desiring to reduce the TCR by 40 ppm/° C., or it is 1.25 parts by weight when desiring to reduce the TCR by 100 ppm/° C.

What is claimed is:

1. A method of manufacturing a resistor paste comprising steps of:

(a) preparing a basic resistor paste comprising
  (i) a conductive powder,
  (ii) a first glass frit, and
  (iii) a first organic medium;

(b) preparing a glass paste as a TCR driver comprising,
  (iv) a second glass frit comprising manganese oxide, and
  (v) a second organic medium; and (c) adding the glass paste to the basic resistor paste to obtain a resistor paste with a desired TCR.

2. The method of manufacturing a resistor paste of claim 1, wherein the manganese oxide is 3 to 69 weight percent, based on the weight of the second glass frit.

3. The method of manufacturing a resistor paste of claim 1, wherein the second glass frit further comprises $SiO_2$, $B_2O_3$, $Al_2O_3$ or a mixture thereof.

4. The method of manufacturing a resistor paste of claim 1, wherein the second glass frit is 10 to 60 wt % based on the weight of the glass paste.

5. The method of manufacturing a resistor paste of claim 1, wherein the glass paste further comprises a third glass frit with softening point of 700 to 950° C.

6. The method of manufacturing a resistor paste of claim 5, wherein the third glass frit is an alkali earth-silicate glass frit comprising a metal oxide selected from the group consisting of silicon oxide ($SiO_2$), calcium oxide (CaO), boron oxide ($B_2O_3$), barium oxide (BaO) and a mixture thereof.

7. The method of manufacturing a resistor paste of claim 1, wherein the conductive powder comprises ruthenium pyrochlore oxide, a ruthenium oxide, silver, palladium, copper, carbon, or a mixture thereof.

8. A method of manufacturing a thick-film chip resistor, comprising:

applying on a substrate a resistor paste prepared according to claim 1; and firing the resistor paste to obtain a thick-film chip resistor.

9. A thick-film chip resistor made by the method of claim 8.

* * * * *